United States Patent [19]

Foster

[11] 4,431,144

[45] Feb. 14, 1984

[54] WATER SKI ROPE STORAGE ACCESSORY

[76] Inventor: Christopher F. Foster, 3648 Foxboro La., Carrollton, Tex. 75007

[21] Appl. No.: 386,985

[22] Filed: Jun. 10, 1982

[51] Int. Cl.[3] ..... B65H 75/40; B65H 75/28

[52] U.S. Cl. ..... 242/85; 242/86.5 A; 242/96

[58] Field of Search ..... 242/85, 53, 86.5 A, 242/86.5 R, 96, 86–86.4; 114/254

[56] References Cited

U.S. PATENT DOCUMENTS

| | | | |
|---|---|---|---|
| 3,423,044 | 1/1969 | Beiderwell | 242/96 |
| 3,494,570 | 2/1970 | Jones, Jr. | 242/86.5 A |
| 3,547,371 | 12/1970 | Grusek | 242/86.5 A X |
| 3,779,478 | 12/1973 | Fugate | 242/86 |
| 3,831,545 | 8/1974 | Cain | 242/86.5 A |
| 4,061,290 | 12/1977 | Harrill | 242/96 |
| 4,072,278 | 2/1978 | Petersen | 242/96 |
| 4,098,213 | 7/1978 | McGinnis | 242/86.5 A X |
| 4,106,719 | 8/1978 | Haverland | 242/96 |
| 4,126,281 | 11/1978 | Young | 242/53 |
| 4,220,293 | 9/1980 | Gename | 242/86.1 |
| 4,238,086 | 12/1980 | Brimmeier | 242/96 |
| 4,244,536 | 1/1981 | Harrill | 242/96 |
| 4,251,038 | 2/1981 | Gename | 242/86 |

*Primary Examiner*—John Petrakes

*Attorney, Agent, or Firm*—Dennis T. Griggs

[57] ABSTRACT

A wind-up accessory for playing out, retrieving and storing a water ski rope and handle bar assembly is disclosed. The storage accessory includes a box enclosure having a reel and spool around which the water ski rope is wound, a crank handle coupled to the reel, and an eyebar attached to the spool for engaging a quick snap fastener attached to the end of a water ski rope. The box enclosure is provided with a slot opening through which the water ski rope is played out and retrieved.

3 Claims, 2 Drawing Figures

WATER SKI ROPE STORAGE ACCESSORY

BACKGROUND OF THE INVENTION

1. Field of the Invention

This invention relates generally to water ski equipment, and in particular to a wind-up accessory for storing a water ski rope and handle bar assembly.

2. Description of the Prior Art

Water ski ropes are typically made of nylon and are provided with a handle bar assembly on one end and a quick connect snap fastener is attached to its opposite end. In use, the quick connect snap fastener is coupled to an eyebar anchored to the rear of a power boat. Typically the ski rope is coiled and placed on the bottom of the boat when not in use. When it is desired to use the ski rope, the quick connect snap fastener is attached to the eyebar, and the ski rope along with the handle is thrown over the side. It will be appreciated that the ski rope can become entangled with other equipment when coiled on the bottom of the boat, and is subject to being damaged by exposure to fuel which may leak into the bottom of the boat from time to time. Additionally, the ski rope is likely to be stepped on by the operator or passengers, and thereby become worn or damaged.

Because of the long length of most ski ropes, the coiled ski rope takes up a substantial amount of space within the confines of the boat. When two ski ropes are used, great care must be exercised to prevent them from becoming entangled when placed on the bottom of the ski boat.

OBJECTS OF THE INVENTION

The principal object of the invention is to provide a wind-up accessory for playing out, retrieving and storing a water ski rope and handle bar assembly, wherein the water ski rope can be played out from the boat without risk of entanglement.

A related object of the present invention is to provide an accessory for storing a water ski rope and handle bar assembly which can be conveniently stowed in a water ski boat.

SUMMARY OF THE INVENTION

A wind-up accessory for playing out, retrieving and storing a water ski rope and handle bar assembly is disclosed. The storage accessory includes a box enclosure having a reel and spool around which the water ski rope is wound, a crank handle coupled to the reel, and an eyebar attached to the spool for engaging a quick connect snap fastener attached to the end of a water ski rope. The box enclosure is provided with a slot opening through which the water ski rope is played out and retrieved. The ski rope handle bar is retained onto the front of the box enclosure by spring clasps.

The novel features which characterize the invention are defined by the appended claims. The foregoing and other objects, advantages, and features of the invention will hereinafter appear, and for purposes of illustration of the invention, but not of limitation, an exemplary embodiment of the invention is shown in the appended drawings.

DESCRIPTION OF THE PREFERRED EMBODIMENT

Figure 1:
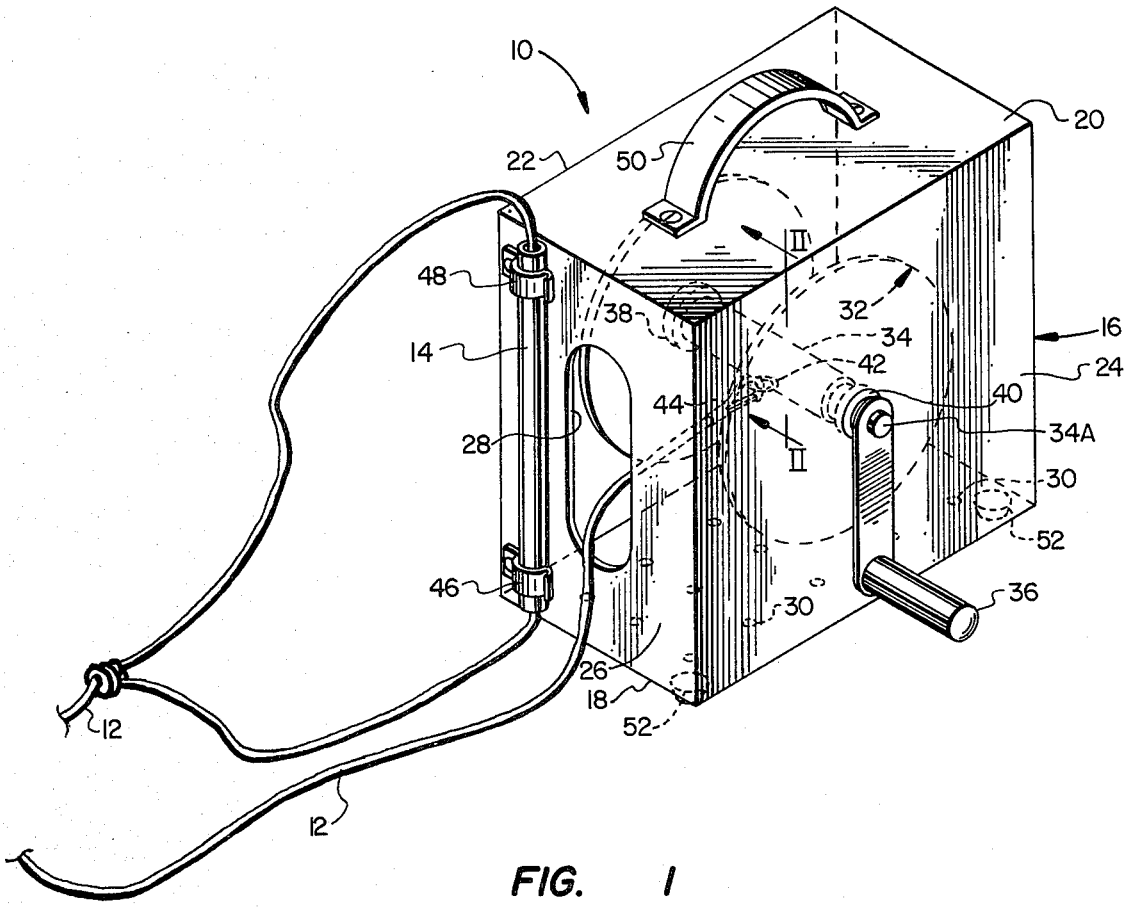
FIG. 1 is a perspective view a wind-up storage accessory for a water ski rope and handle bar assembly; and, FIG. 2 is a sectional view taken along the lines II—II of FIG. 1.
Figure 2:
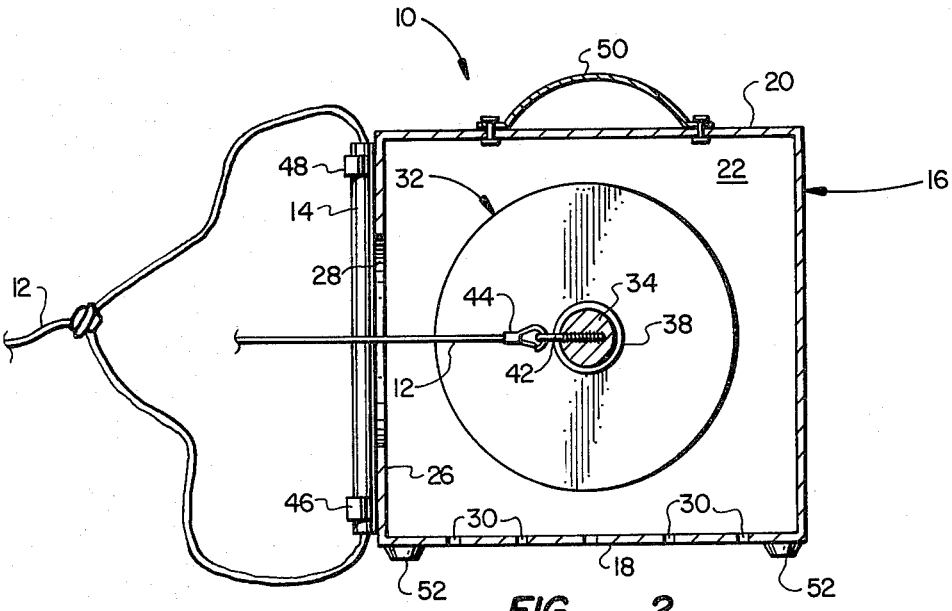

Referring now to FIG. 1, a wind-up accessory 10 is provided for playing out, retrieving and storing a water ski rope 12 and handle bar 14. The wind-up accessory 10 is embodied in a box enclosure 16 having a bottom panel 18, a top panel 20, left and right side panels 22, 24, respectively and a front panel 26. The front panel 26 is provided with a slot opening 28 through which the ski rope 12 is played out and retrieved. The bottom panel 18 is provided with perforations 30 which form drain openings.

Received within the box enclosure 16 is a reel 32 including a spool 34 which are rotatably supported between the left and right side panels 22, 24, respectively. The spool 34 includes a protruding end portion 34A to which a crank handle 36 is attached. The opposite ends of the spool 34 are preferably received within sleeve bearings 38, 40, respectively.

According to an important feature of the invention, an eyebar 42 is attached to the spool 34 for coupling engagement with one end of the water ski rope 12. The water ski rope 12 is terminated at one end by the handle bar assembly 14, and at the other end by a quick connect snap fastener 44. According to this arrangement, the end of the ski rope can be quickly and easily attached or released from the wind-up accessory 10. When attached to the eyebar, the ski rope is wound about the spool 34 until all of the ski rope has been taken in. When it is desired to play-out the ski rope, the ski rope is manually pulled through the slot 28 while the reel 32 and crank handle turn freely.

According to another important feature of the invention, first and second spring clasps 46, 48 are secured to the front panel 26 along the left side panel edge. The spring clasps 46, 48 receive and compressively engage the handle bar 14 of the ski rope assembly. The spring clasps 46, 48 hold the handle bar 14 in place when the water ski rope has been retrieved.

The panel members of the box enclosure 16 are preferably constructed of non-corrosive, water-resistant materials such as plastic or aluminum. The spool, reel and crank handle are likewise constructed of a water-resistant, non-corrosive material. For convenience, a carrying handle 50 is secured to the top panel 20. Four rubber feet 52 are secured to the underside of the bottom panel 18 thereby providing a drainage space for the drain openings 30.

Although a preferred embodiment of the invention has been described in detail, it should be understood that various changes, substitutions and alterations can be made therein without departing from the spirit and scope of the invention as defined by the appended claims.

What is claimed is:

1. A wind-up accessory for playing out, retrieving and storing a water ski rope and handle bar assembly comprising, in combination:

a box enclosure having a bottom panel, a top panel, left and right side panels and a front panel secured between said top and bottom panels, said front panel having a slot opening and said bottom panel having perforations defining water drainage openings;

a reel including a spool rotatably supported in said box enclosure between said left and right side panels;

a crank handle coupled to said reel;

an eye bar attached to said spool for coupling engagement with a quick connect snap fastener attached to the end of a water ski rope; and, first and second spring clasps secured to said front panel adjacent said slot opening, said spring clasp being spaced along one edge of said front panel for receiving and compressively engaging the handle bar of a ski rope assembly.

2. A wind-up accessory as defined in claim 1, further including a carrying handle coupled to said top panel for facilitating transport of said wind-up accessory.

3. A wind-up accessory as defined in claim 1, further including a water ski rope having a handle bar assembly at one end thereof and a quick connect snap fastener at the other end thereof, said quick connect snap fastener being attached to said eye bar for allowing said ski rope to be selectively wound on and played out from said reel.

* * * * *